US011046548B2

(12) United States Patent
Nasu

(10) Patent No.: US 11,046,548 B2
(45) Date of Patent: Jun. 29, 2021

(54) CUTTING APPARATUS

(71) Applicant: NAMX COMPANY LIMITED, Fukuyama (JP)

(72) Inventor: Nobuo Nasu, Fukuyama (JP)

(73) Assignee: NAMX COMPANY LIMITED, Fukuyama (JP)

( * ) Notice: Subject to any disclaimer, the term of this patent is extended or adjusted under 35 U.S.C. 154(b) by 0 days.

(21) Appl. No.: 16/495,985

(22) PCT Filed: Mar. 22, 2018

(86) PCT No.: PCT/JP2018/011541
§ 371 (c)(1),
(2) Date: Sep. 20, 2019

(87) PCT Pub. No.: WO2018/174205
PCT Pub. Date: Sep. 27, 2018

(65) Prior Publication Data
US 2020/0048024 A1 Feb. 13, 2020

(30) Foreign Application Priority Data
Mar. 23, 2017 (JP) ..... JP2017-058230

(51) Int. Cl.
*B65H 35/00* (2006.01)
*D06H 7/04* (2006.01)
*B65H 43/00* (2006.01)

(52) U.S. Cl.
CPC ..... *B65H 35/0086* (2013.01); *B65H 43/00* (2013.01); *D06H 7/04* (2013.01)

(58) Field of Classification Search
CPC ..... B65H 43/00; D06H 7/04
See application file for complete search history.

(56) References Cited

U.S. PATENT DOCUMENTS 6,001,198 A 12/1999 Habisreitinger et al.
2006/0162512 A1* 7/2006 Nasu ..... B26D 7/20 83/13
2009/0107314 A1* 4/2009 Nasu ..... B26D 7/08 83/86

FOREIGN PATENT DOCUMENTS

BR 9705054 A 3/1999
CA 2218453 A1 4/1998
(Continued)

OTHER PUBLICATIONS

International Search Report, issued in PCT/JP2018/011541, dated Jun. 19, 2018.
(Continued)

*Primary Examiner* — Omar Flores Sanchez
(74) *Attorney, Agent, or Firm* — Birch, Stewart, Kolasch & Birch, LLP

(57) ABSTRACT

A cutting apparatus cuts a fabric using a rotary blade and a fixed blade that are built into a cutter head. The fixed blade is linked, to the other-end side of a swing arm of which one end is pivotally fitted on a blade frame by a swing shaft. The fixed blade is urged by a coil spring connected to the one-end side of the swing arm. When a prescribed resistance force is applied to the fixed blade, a position sensor detects movement of the swing arm, a fixed blade drive cylinder drives the swing arm in response to the detection, and the fixed blade is moved to an accommodation position that is above the position during cutting and that is on an opposite side in the advancing direction of the cutter head.

8 Claims, 8 Drawing Sheets

(56) References Cited

FOREIGN PATENT DOCUMENTS

| | | | |
|---|---|---|---|
| CN | 1186037 | A | 7/1998 |
| CN | 102144062 | A | 8/2011 |
| CN | 103391833 | A | 11/2013 |
| DE | 196 42 831 | A1 | 4/1998 |
| ES | 2 143 825 | T3 | 5/2000 |
| JP | 3-88563 | A | 4/1991 |
| JP | 4-23559 | A | 1/1992 |
| JP | 10-180682 | A | 7/1998 |
| JP | 2009-202278 | A | 9/2009 |
| JP | 2010-65340 | A | 3/2010 |
| JP | 5106646 | B2 | 12/2012 |
| MX | 9707983 | A | 7/1998 |
| WO | WO 2010/029809 | A1 | 3/2010 |
| WO | WO 2012/111268 | A1 | 8/2012 |

OTHER PUBLICATIONS

Written Opinion of the International Searching Authority, issued in PCT/JP2018/011541, dated Jun. 19, 2018.
JPO Notice of Reasons for Refusal for Japanese Application No. 2019507000 dated Sep. 1, 2020.

* cited by examiner

CUTTING APPARATUS

TECHNICAL FIELD

The present invention relates to a cutting apparatus that cuts a sheet material such as a fabric by a first cutting blade and a second cutting blade of a cutter head driven along a support surface of the sheet material.

BACKGROUND

Conventionally, as a cutting apparatus that cuts a fabric for clothing to prepare a pattern piece, a plotter type cutting apparatus is available. The plotter type cutting apparatus is equipped with a cutting table having a support surface supporting a fabric, a pair of carriages traveling along two rails extending at a longitudinal edge portion of the cutting table, a beam member bridging between the pair of carriages, and a cutter head traveling along a rail installed on this beam member. In the cutting apparatus, cutting data indicating the cutting pattern of a pattern piece is input to a control unit, and while operating a cutter built in the cutter head based on the cutting data, the cutter head is driven within a plane parallel to the support surface to cut the fabric to thereby prepare the pattern piece.

As a cutting apparatus of this type, there exists one the cutter head of which is provided with a rotary blade and a fixed blade as the cutters, with the fabric being cut by the shearing force of the rotary blade and the fixed blade (See, for example, Patent Literature 1). As shown in FIG. 10, this cutting apparatus is equipped with a rotary blade 129 rotatably pivoted to a blade frame 125 in the cutter head, a swing lever 137 one end of which is pivoted to the blade frame 125 by a swing shaft 138, and a leaf spring 140 connected to one end of the swing lever 137 and having a fixed blade 143 fixed to the distal end thereof. On the other end side of the swing lever 137, there is arranged a fixed blade drive cylinder 53 driving the swing lever 137. The swing lever 137 is urged toward a fixed blade cylinder 136 side by a coil spring 139 provided at the other end side, and a fixed blade 143 at the distal end of the leaf spring 140 connected to the swing lever 137 is urged toward a fabric 110 side, which is the object of cutting. The fabric 110 is supported by a support surface 103 of the cutting apparatus. The fixed blade 143 is held by a fixed blade holder 142 pivoted to the distal end of the leaf spring 140 by an inversion shaft 141, and an attracted portion provided on the side of the fixed blade holder 142 farther from the fixed blade 143 is attracted by a permanent magnet 144 provided on the leaf spring 140.

In this cutting apparatus, during non-cutting time when the rotary blade 129 and the fixed blade 143 do not cut the fabric 110 and during notching when a notch for inserting the fixed blade 143 into the fabric 110 is formed at the time of the start of the cutting of the fabric 110, the swing lever 137 is driven by the fixed blade cylinder 136 against the urging force of the coil spring 139, and the fixed blade 143 is moved upwards. As a result, the engagement of the blade edge of the fixed blade 143 with the cutting edge of the rotary blade 129 is released.

In the above-described conventional cutting apparatus, when performing the operation of cutting the fabric 110 it may occur that an excessive resistance force is exerted on the fixed blade 143 from the fabric 110 due to a reduction in the sharpness of the rotary blade 129 and the fixed blade 143 and to wrinkles generated in the fabric 110. As shown in FIG. 11, when this excessive resistance force is exerted on the fixed blade 143, the attracted portion of the fixed blade holder 142 is released from the attraction force of the permanent magnet 144, and the fixed blade 143 rotates as indicated by the arrow S. As a result, the fixed blade 143 is reversed such that the distal end of the fixed blade 143 is directed in a direction opposite the cutter head driving direction indicated by the arrow F. At this time, the distal end of the fixed blade 143 receives a reaction force from the support surface 103, and the leaf spring 140 swings upwards as indicated by the arrow P, causing the swing lever 137 to swing. The swinging of the swing lever 137 is detected by a limit switch, and, in response thereto, a motor 130 driving the rotary blade 129 is stopped, and the driving of the cutter head is stopped. As a result, the fixed blade 143 is prevented from being caught by the fabric 110 to cause the fabric 110 to move in the cutter head driving direction, and the fabric 110 and the fixed blade 143 are prevented from suffering damage.

Patent Literature 1: Japanese Patent No. 5106646

SUMMARY

Problems to be Solved by the Invention

However, in the above-described conventional cutting apparatus, in order to reverse the fixed blade 143, the fixed blade holder 142 is pivoted to the distal end of the leaf spring 140 by the inversion shaft 141 to hold it by the permanent magnet 144, resulting in a rather complicated structure. Further, when the fixed blade 143 is reversed, the distal end of the fixed blade 143 comes into contact with the support surface 103, so that there is a fear of the support surface 103 being damaged. In the case where the support surface 103 is formed by a conveyor to convey the fabric 110, the support surface 103, which is formed of a flexible material, is subject to damage, and damage of the support surface 103 may lead to loss of the conveyor function.

In view of this, it is an object of the present invention to provide a cutting apparatus, which, when a resistance force is exerted on the cutting blade from the sheet material which is the object of cutting, is possible to prevent the cutting blade from being caught by the sheet material, to prevent movement of the sheet material, and to prevent damage of the sheet material and the cutting blade through a simple structure without damaging the support surface of the sheet material.

Solution to Problems

In order to solve the problems, cutting apparatus according to the present invention comprises:

a support surface supporting a sheet material;

a cutter head having a first cutting blade coming into contact with the sheet material on the support surface from a side farther from the support surface and a second cutting blade coming into contact with the sheet material from a side nearer to the support surface; and a cutter head drive mechanism driving the cutter head within a plane parallel to the support surface, with the cutter head having a second cutting blade drive portion driving the second cutting blade at the time of notching the sheet material to an accommodation position above the position at the time of cutting the sheet material, wherein when, at the time of cutting the sheet material, a predetermined resistance force is exerted on the second cutting blade from the sheet material, the second cutting blade drive portion drives the second cutting blade to the accommodation position.

In the above-described structure, the sheet material supported by the support surface is cut by the first cutting blade and the second cutting blade of the cutter head, and this cutter head is driven within a plane parallel to the support surface by the cutter head drive mechanism, whereby the sheet material is cut in a predetermined configuration. At the time of notching for forming a notch for inserting the second cutting blade when the cutter head starts the cutting of the sheet material, the second cutting blade is driven to an accommodation position above the position at the time of cutting the sheet material. At the time of the cutting of the sheet material by the first cutting blade and the second cutting blade, when a predetermined resistance force is exerted on the second cutting blade from the sheet material, the second cutting blade is driven to the accommodation position by the second cutting blade drive portion. As a result, it is possible to prevent the second cutting blade from being caught by the sheet material, to prevent the sheet material from being caught by the second cutting blade to move, and to prevent the first cutting blade or the second cutting blade from suffering damage. Here, in the cutting apparatus of the present invention, the second cutting blade is retracted to the accommodation position by utilizing the second cutting blade drive portion, so that there is no need to provide a dedicated fixed blade retracting mechanism as in the conventional cutting apparatus. Thus, it is possible to simplify the structure of the cutting apparatus as compared with the prior art. Further, the second cutting blade is driven by the second cutting blade drive portion to the accommodation position above the position when cutting the sheet material, so that it does not come into contact with the support surface. Thus, it is possible to effectively eliminate a problem in the conventional cutting apparatus, that is, to prevent the distal end of the reversing fixed blade from coming into contact with the support surface to damage the support surface.

In one embodiment of the cutting apparatus, the first cutting blade is a rotary blade; and the second cutting blade is a fixed blade arranged such that at the time of cutting the sheet material, a distal end thereof is directed in the driving direction of the cutter head, and that a side edge portion thereof is in contact with a peripheral edge portion of the rotary blade.

In the above-described embodiment, the peripheral edge portion of the rotary blade and the side edge portion of the fixed blade come into contact with each other to exert a shearing effect to cut the sheet material. Here, the fixed blade as the second cutting blade is driven by the second cutting blade drive portion to the accommodation position above the position when the sheet material is cut, so that it is possible to effectively prevent the distal end of the reversing fixed blade from coming into contact with the support surface to damage the support surfaces as in the conventional cutting apparatus.

In one embodiment of the cutting apparatus, the second cutting blade is driven by the second cutting blade drive portion to the accommodation position that is on the side opposite the driving direction of the cutter head with respect to the position at the time of cutting the sheet material.

In the above-described embodiment, the second cutting blade is driven to the accommodation position above the position when the sheet material is cut and on a side opposite the cutter head driving direction, so that there is no fear of the support surface being damaged as in the conventional cutting apparatus, making it possible to prevent the second cutting blade from being caught by the sheet material.

In one embodiment of the cutting apparatus, the second cutting blade is retained such that at the time of cutting the sheet material, it comes into contact with the first cutting blade at a position offset to the side opposite the driving direction of the cutter head with respect to a normal extending downwards to the support surface from a rotation center of the first cutting blade.

In the above-described embodiment, when cutting the sheet material, the first cutting blade and the second cutting blade come into contact with each other at a position offset to the side opposite the cutter head driving direction from the normal extending to the support surface from the rotation center of the first cutting blade, whereby the sheet material is cut effectively. The second cutting blade thus performing cutting can be effectively driven by the second cutting blade drive portion to the accommodation position above the position when the sheet material is cut and on the side opposite the cutter head driving direction.

In one embodiment of the cutting apparatus, the support surface is formed by a moquette-like sheet.

In the above-described embodiment, the sheet material is arranged on the support surface formed by a moquette-like sheet, whereby it is possible to insert the distal end portion of the second cutting blade into the moquette-like sheet, making it possible to bring the second cutting blade into contact with the sheet material from the side nearer to the support surface.

In one embodiment of the cutting apparatus, the second cutting blade drive portion has:

an urging portion urging the second cutting blade toward the support surface side; and an actuator driving the second cutting blade to the accommodation position against the urging force of the urging portion.

In the above-described embodiment, the second cutting blade is urged by the urging portion, and is held at a position where a shearing effect is exerted through cooperation with the first cutting blade. On the other hand, when a predetermined resistance force is exerted on the second cutting blade from the sheet material, the second cutting blade is driven by the actuator to the accommodation position against the urging force of the urging portion, so that it is possible to effectively prevent the second cutting blade from being caught by the sheet material. Here, as the actuator, it is possible to employ a linear drive actuator such as a cylinder or a linear motor, and a rotary actuator such as an electric motor or an air motor.

In one embodiment of the cutting apparatus, the second cutting blade drive portion has:

a swing arm which is pivoted to a frame of the cutter head by a swing shaft and to which the second cutting blade is connected;

an urging portion connected to a side opposite the second cutting blade with respect to the swing shaft of the swing arm and urging the swing arm in a direction in which the second cutting blade advances toward the support surface;

a drive pin provided on the side to which the second cutting blade is connected with respect to the swing shaft of the swing arm;

an elongated hole linking part having an elongated hole with which the drive pin is slidably fit-engaged; and a linear drive actuator driving the drive pin against the urging force of the urging portion via the elongated hole linking part.

In the above-described embodiment, the swing arm which is pivoted to the frame of the cutter head by the swing shaft and to which the second cutting blade is connected is urged by the urging portion connected to the side opposite the second cutting blade with respect to the swing shaft of the swing arm, and, with this, the second cutting blade is urged toward the support surface. The drive pin provided on the side to which the second cutting blade is connected with respect to the swing shaft of the swing arm is slidably fit-engaged with the elongated hole of the elongated hole linking part. When cutting is performed by the first cutting blade and the second cutting blade, the position of the second cutting blade is maintained in a stable manner on the support surface side by the urging force of the urging portion. On the other hand, when a predetermined resistance force is exerted on the second cutting blade, the drive pin is driven by the linear drive actuator via the elongated hole linking part against the urging force of the urging portion, and the second cutting blade moves away from the support surface. In this way, due to the second cutting blade drive portion, it is possible to retain the second cutting blade at a predetermined position in a stable manner. Here, as the linear drive actuator, it is possible to employ a cylinder, a linear motor or the like.

In one embodiment, the cutting apparatus further comprises:

a position sensor detecting the position of the swing arm of the second cutting blade drive portion; and a control unit which, upon detection that the displacement of the second cutting blade has exceeded a predetermined value based on the position of the swing arm from a signal from the position sensor, operates the linear drive actuator, and drives the second cutting blade away from the support surface via the elongated hole linking part, the drive pin, and the swing arm.

In the above-described embodiment, the position of the swing arm of the second cutting blade drive portion is detected by the position sensor. When it is detected based on the signal from this position sensor that the displacement of the second cutting blade has exceeded a predetermined value, the linear drive actuator is operated by the control unit, and the second cutting blade is driven away from the support surface via the elongated hole linking part, the drive pin, and the swing arm. As a result, it is possible to effectively accommodate and retract the second cutting blade to the accommodation position in accordance with the displacement in the case where a predetermined resistance force is exerted on the second cutting blade.

In one embodiment of the cutting apparatus, the second cutting blade drive portion has:

a parallel link mechanism formed by a fixed link fixed to the frame of the cutter head, a first arm arranged so as to cross the fixed link and swingably pivoted, a second arm one end of which is connected to one end of the first arm and arranged parallel to the fixed link, and to which the second cutting blade is connected, and a swing link both ends of which are respectively pivoted to the fixed link and the second arm and which is arranged parallel to the first arm;

an urging portion connected to the other end of the first arm of the parallel link mechanism and urging the first arm to bring the second cutting blade toward the support surface; and a linear drive actuator driving the other end side of the first arm of the parallel link mechanism against the urging force of the urging portion.

In the above-described embodiment, the parallel link mechanism is formed by the fixed link fixed to the frame of the cutter head, the first arm, the second arm to which the second cutting blade is connected, and the swing link. The first arm is urged by the urging portion connected to the other end of the first arm of the parallel link mechanism, and the second cutting blade connected to the second arm is urged toward the support surface. As a result, when, for example, cutting is performed by the first cutting blade and the second cutting blade, the position of the second cutting blade is retained in a stable manner on the support surface side. On the other hand, when, for example, a predetermined resistance force is exerted on the second cutting blade, the other end side of the first arm of the parallel link mechanism is driven by the linear drive actuator against the urging force of the urging portion, and the second cutting blade moves away from the support surface. In this way, due to the second cutting blade drive portion, it is possible to retain the second cutting blade at a predetermined position in a stable manner. Here, as the linear drive actuator, it is possible to employ a cylinder, a linear motor or the like.

In one embodiment, the cutting apparatus further comprises:

a position sensor detecting the position of the first arm, the second arm, or the swing link of the second cutting blade drive portion; and a control unit which, upon detection that the displacement of the second cutting blade has exceeded a predetermined value based on the position of the first arm, the second arm, or the swing link from a signal from the position sensor, operates the linear drive actuator, and drives the second cutting blade away from the support surface via the first arm and the second arm.

In the above-described embodiment, the position of the first arm of the second cutting blade drive portion, the second arm, or the swing link is detected by the position sensor. When it is detected based on the signal from this position sensor that the displacement of the second cutting blade has exceeded a predetermined value, the linear drive actuator is operated by the control unit, and the second cutting blade is driven away from the support surface via the first arm and the second arm. As a result, it is possible to effectively accommodate and retract the second cutting blade to the accommodation position in accordance with the displacement in the case where a predetermined resistance force is exerted on the second cutting blade.

In one embodiment of the cutting apparatus, when the displacement of the second cutting blade exceeds a predetermined value, the control unit stops the operation of the first cutting blade.

In the above-described embodiment, when the displacement of the second cutting blade exceeds a predetermined value, the second cutting blade is driven away from the support surface by the control unit, and, in addition thereto, the operation of the first cutting blade is stopped, so that it is possible to effectively stop the operation of the first cutting blade and the second cutting blade. Thus, it is possible to effectively prevent the first cutting blade and the second cutting blade from being damaged, and to prevent the sheet material from being damaged.

In one embodiment of the cutting apparatus, when the displacement of the second cutting blade exceeds a predetermined value, the control unit stops the operation of the cutter head drive mechanism.

In the above-described embodiment, when the displacement of the second cutting blade exceeds a predetermined value, the operation of the cutter head drive mechanism is stopped by the control unit, so that it is possible to effectively stop the movement of the first cutting blade and the second cutting blade. Thus, it is possible to effectively prevent the first cutting blade and the second cutting blade from being caught by the sheet material and moving, to prevent the first cutting blade and the second cutting blade from suffering damage, and to prevent the sheet material from suffering damage.

DESCRIPTION OF EMBODIMENTS

In the following, an embodiment of the present invention will be described in detail with reference to the attached drawings.

Figure 1:
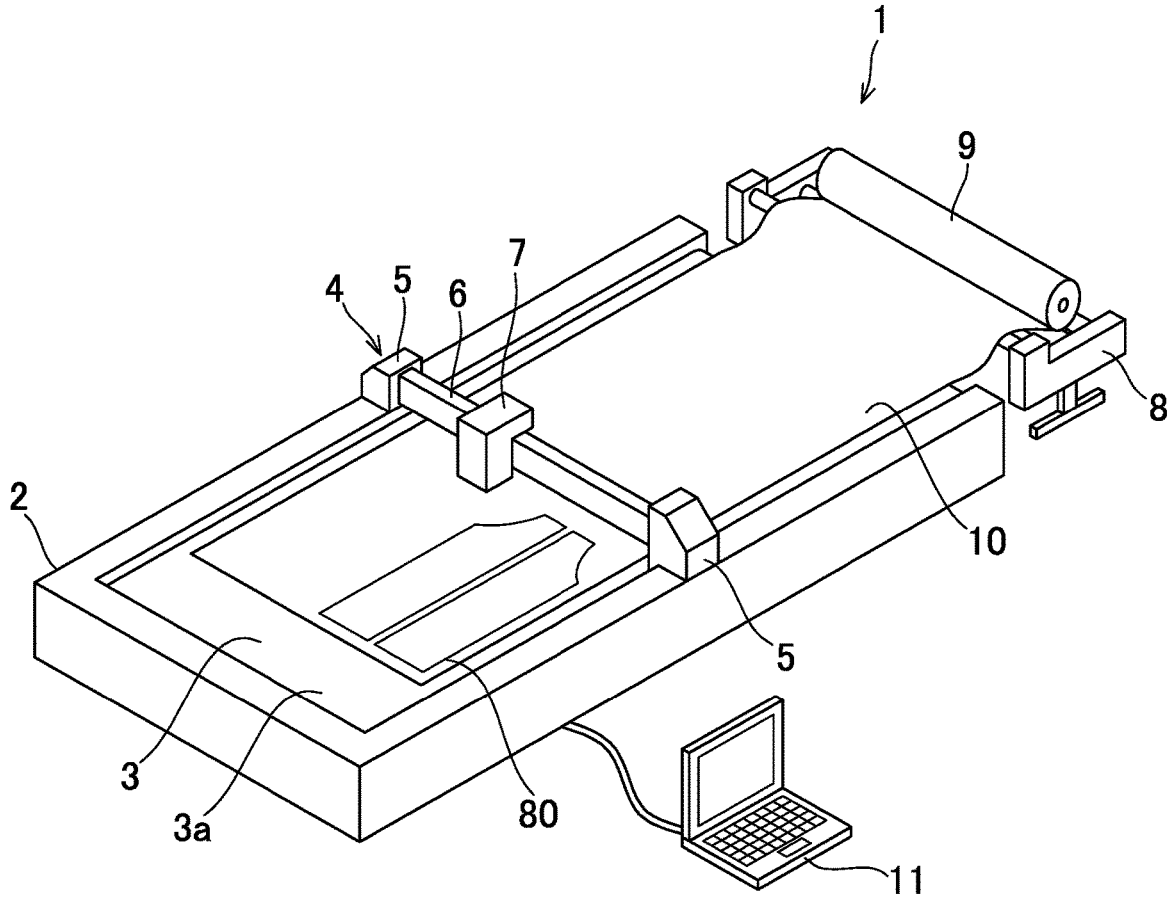
FIG. 1 is a schematic general perspective view of a cutting apparatus as an embodiment of the present invention.

The cutting apparatus of the embodiment of the present invention is a plotter type cutting apparatus for preparing a clothing pattern piece by cutting a fabric as the sheet material. As shown in FIG. 1, a cutting apparatus 1 is schematically composed of a cutting table 2, a cutter unit 4, an unwinding machine 8, and a control device 11.

The cutting table 2 has a built-in belt conveyor conveying a fabric 10 from the unwinding machine 8 and supporting the fabric 10 at the time of cutting. In the belt conveyor, a conveyor belt 3 is expanded between pulleys (not shown) built in both longitudinal ends of the cutting table 2 and extending in the lateral direction. The upper side surface of this conveyor belt 3 is exposed on the upper side of the cutting table 2, and functions as a support surface 3*a* supporting the fabric 10. The conveyor belt 3 is formed of a moquette-like sheet with a velour 57 knitted into a base cloth 56. The velour 57 of the conveyor belt 3 is fluffy, and a fixed blade 48 of a cutter unit 4 gets into the velour 57, whereby it is possible to come into contact with the fabric 10 supported on the surface from the side nearer to the support surface 3*a*.

The cutter unit 4 is equipped with a pair of carriages 5 traveling along two rails installed at the edge portion in the longitudinal direction of the cutting table 2, a beam member 6 bridging between the pair of carriages 5 and extending in the lateral direction of the cutting table 2, and a cutter head 7 traveling along a rail installed on the beam member 6. The cutter head 7 has, in a built-in state, a rotary blade 32 as the first cutting blade cutting the fabric 10, and a fixed blade 48 as the second cutting blade. The cutter head 7 is moved in the longitudinal direction of the cutting table 2 by the carriages 5, and is moved in the lateral direction of the cutting table 2 by a drive mechanism built in the cutter head 7 and the beam member 6, whereby it is driven within a plane parallel to the support surface 3*a* of the cutting table 2. In this way, a cutter head drive mechanism is formed by the carriages 5 and the drive mechanism provided in the cutter head 7 and the beam member 6.

The unwinding machine 8 is arranged at one end side of the belt conveyor built in the cutting table 2 so as to be adjacent to the shorter side of this cutting table 2. In the state in which a fabric roll 9 is placed on it, the unwinding machine 8 rotation-drives this roll 9 to draw out the fabric 10. This unwinding machine 8 is rotation-driven by a motor (not shown), and has two unwinding rollers arranged parallel to each other at a predetermined interval. The roll 9 is placed on the upper side between the unwinding rollers so as to be in contact with these two unwinding rollers, and as the unwinding rollers rotate, the fabric is drawn out of the roll 9. On the cutting table 2 side of the unwinding rollers, the unwinding machine 8 is provided with a guide roller feeding the fabric 10 drawn out of the unwinding rollers to the cutting table 2.

The control device 11 is connected to the cutting table 2 and the unwinding machine 8, and serves to control the operation of the unwinding machine 8 and the belt conveyor when the fabric 10 is drawn out onto the support surface 3*a* of the cutting table 2, and the operation of the cutter unit 4 when the fabric 10 placed on the support surface 3*a* is cut, thus functioning as a control unit. The control device 11 consists of a notebook computer on the market (personal computer). Input to the control device 11 by the operator is information on a cutting pattern 80, and based on the information input, the operation of the unwinding machine 8, the belt conveyor, and the cutter unit 4 is controlled. It is also possible to build in a control unit of a similar function to that of the control device 11 in the cutting table 2 or the unwinding machine 8, and to provide an input portion formed by a touch panel or the like on the carriages 5 of the cutter unit 4 of the cutting table 2, on the frame of the unwinding machine 8 or the like.

Figure 2:
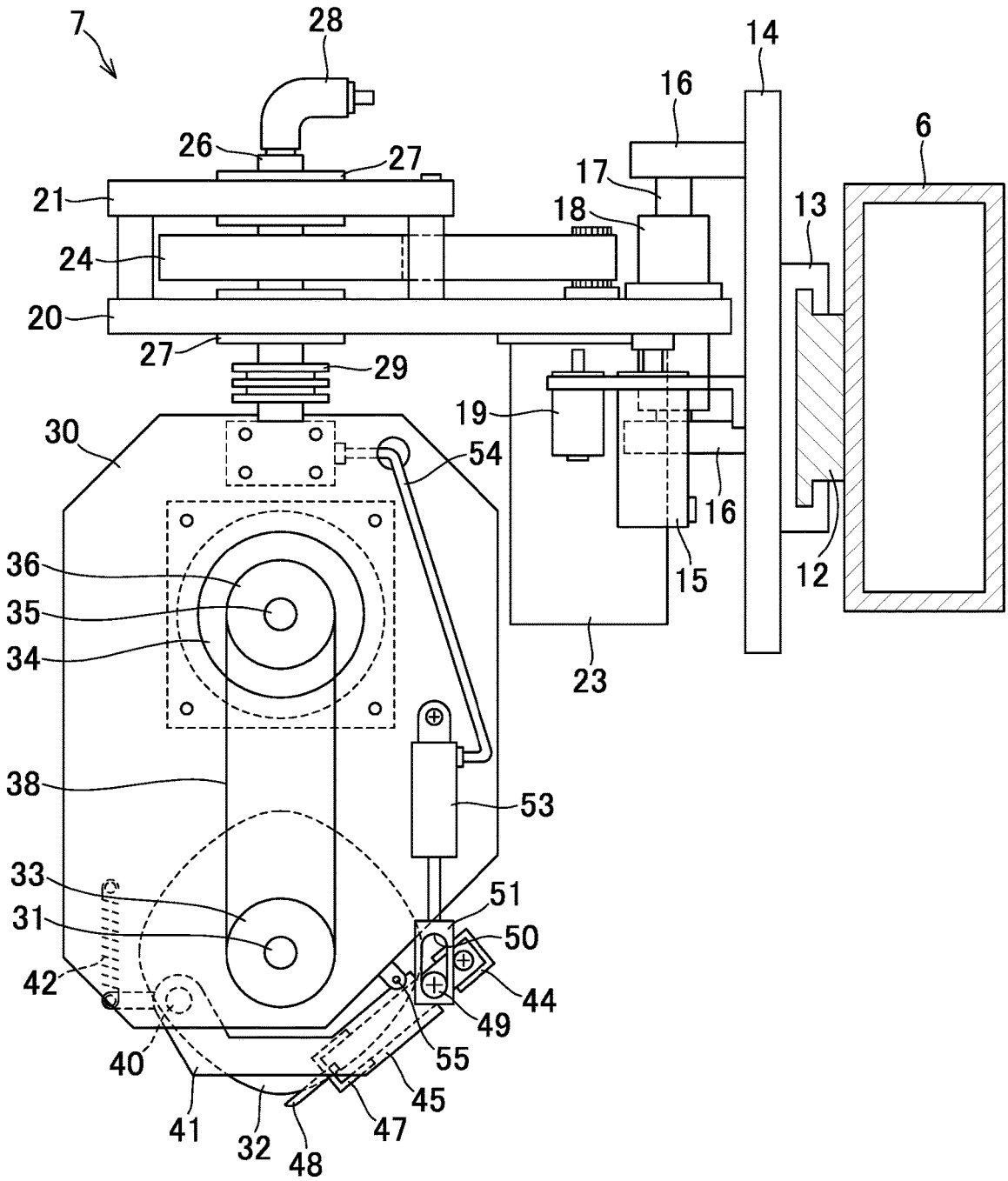
FIG. 2 is a side view of a cutter head that the cutting apparatus of a first embodiment has.

FIG. 2 is a side view illustrating the structure of the cutter head 7 of the first embodiment. The cutter head 7 can be moved along a guide rail 12 fixed to the side surface of the beam member 6 by a guide 13 provided on the back surface of a plate-like frame 14. The cutter head 7 is driven in the extending direction of the guide rail 12 by a driving pulley installed in one carriage 5 and driven by a motor, a driven pulley arranged in the other carriage, and a timing belt stretched between the driving pulley and the driven pulley and partially arranged on the inner side of the beam member 6. The components of the cutter head 7 shown in FIG. 2 are covered with a cover (not shown).

On the front side of the frame 14 of the cutter head 7, there is mounted a guide shaft 17 between a pair of mounting arms 16, 16 installed so as to be vertically spaced away from each other. Fit-engaged with this guide shaft 17 is a slide bearing 18 fixed to a vertically moving frame 20, and this vertically moving frame 20 is driven in the vertical direction along the guide shaft 17 by a vertically moving cylinder 15 to which the distal end of a rod is connected. Further, adjacent to the vertically moving cylinder 15, there is provided a cutting height cylinder 19 the distal end of the rod of which abuts the vertically moving frame 20 at the time of cutting to adjust the height of the vertically moving frame 20. During the non-cutting period when the cutter head 7 does not cut the fabric 10, the vertically moving cylinder 15 is set so as to drive the vertically moving frame 20 upwards to move a rotary blade 32 and a fixed blade 48 away from the support surface 3*a* of the cutting table 2. On the other hand, during the cutting period when the cutter head 7 cuts the fabric 10, the cutting height cylinder 19 arranges the fixed blade 48 on the support surface 3*a* side of the fabric 10, and then slightly raises the vertically moving frame 20. As a result, setting is made such that shearing is effected by the rotary blade 32 and the fixed blade 48 in the state in which the fabric 10 is raised by the fixed blade 48, enhancing the cutting efficiency for the fabric 10. It is also possible to form the apparatus such that the operation of the cutting height cylinder 19 is executed by the vertically moving frame 20, eliminating the cutting height cylinder 19. A cutter rotation motor 23 is installed on the vertically moving frame 20, and the rotational force of this cutter rotation motor 23 is transmitted to the cutter rotation pulley via a toothed belt 24, and is transmitted to a hollow rotation shaft 26 connected to this cutter rotation pulley and supported by a rotation bearing 27. The rotation shaft 26 is rotatably supported by a rotation bearing 27 provided on the vertically moving frame 20 and a rotation bearing 27 provided on an auxiliary frame 21 on the vertically moving frame 20. The upper end of the rotation shaft 26 is connected to an air joint 28 to which air to be supplied to a fixed blade drive cylinder 53 is guided, whereas the lower end of the rotation shaft 26 is fixed to a plate-like blade frame 30. Further, the rotation shaft 26 is provided with a collector ring 29 for transmitting supply power for a cutter rotation motor 34 and signals from a position sensor 55 between the vertically moving frame 20 and the blade frame 30.

Figure 3:
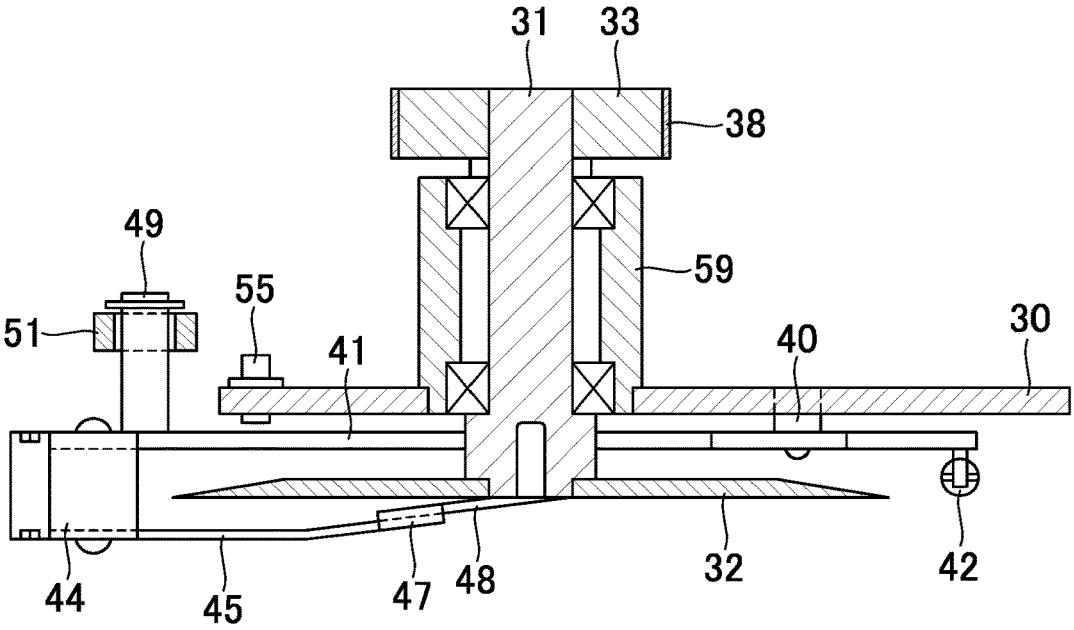
FIG. 3 is a plan sectional view of the main portion of the cutter head.

FIG. 3 is a plan sectional view of the portion in the vicinity of the lower end of the blade frame 30 of the cutter head 7. At a position somewhat above the lower end of the blade frame 30, there is formed an axial hole, and a cutter shaft 31 is inserted into this axial hole, with this cutter shaft 31 being rotatably supported at the blade frame 30 by the cutter bearing 59. At one end of the cutter shaft 31, there is fixed a rotary blade 32 by a cutter check nut. The rotary blade 32 is generally of a circular configuration, and is formed by four arcs of small radius of curvature and four arcs of large radius curvature alternately connected together. The entire periphery of the peripheral edge portion of the generally circular rotary blade 32 consists of a blade tip, which is periodically polished by a polishing device (not shown). Below the fixed position of the rotation shaft 26 of the blade frame 30, there is fixed in position a cutter rotation motor 34, and a driving pulley 36 is fixed to an output shaft 35 of the cutter rotation motor 34. A driven pulley 33 is fixed to the other end of the cutter shaft 31 situated below the driving pulley 36, and a toothed belt 38 is wrapped around the driving pulley 36 and the driven pulley 33. The rotational force of the cutter rotation motor 34 is transmitted to the driven pulley 33 from the driving pulley 36 via the toothed belt 38, and the cutter shaft 31 rotates, rotation-driving the rotary blade 32.

At the lower end of the blade frame 30, there is provided a swing arm 41 pivoted by a swing shaft 40 provided on the side of the advancing direction of the cutter head 7 with respect to the cutter shaft 31. The swing arm 41 is of a configuration bent so as to be convex toward the support surface 3*a* side, and one end thereof is pivoted by the swing shaft 40, whereas the other end thereof is connected to a leaf spring 45 by a leaf spring holder 44. The leaf spring 45 is of a rectangular configuration, and, in side view, is situated below the rotary blade 32 and on the side opposite the advancing direction of the cutter head 7 of the cutter shaft 31. As shown in FIG. 3, the swing arm 41 is arranged between the blade frame 30 and the rotary blade 32, and the leaf spring 45 is arranged on the side opposite the swing arm 41 with respect to the rotary blade 32. The fixed blade 48 is fixed to the distal end of the leaf spring 45 by a fixed blade holder 47. The distal end of the fixed blade 48 is of a pointed thin and narrow rectangular configuration, and the side edge portion thereof constitutes the blade edge. At the time of cutting, it comes into contact with the blade edge at the peripheral edge portion of the rotary blade 32, whereby it exerts a shearing effect to cut the fabric 10.

At the other end side of the swing arm 41, there is provided, on the side opposite the side connected to the leaf spring 45, a drive pin 49 receiving a drive force from a fixed blade drive cylinder 53. This drive pin 49 protrudes to the side opposite the side where the rotary blade 32 is arranged with respect to the blade frame 30, and is slidably fit-engaged with the elongated hole of an elongated hole linking part 51. The elongated hole linking part 51 is connected to the distal end of the rod of the fixed blade drive cylinder 53, and has an elongated hole 50 extending in the direction in which it is driven by the fixed blade drive cylinder 53. The fixed blade drive cylinder 53 is arranged on the side opposite the side where the rotary blade 32 of the blade frame 30 is arranged, and is supplied with air constituting operation fluid by an air hose 54 connected to the lower end of the rotation shaft 26. This fixed blade drive cylinder 53 expands and contracts the rod to drive the elongated hole linking part 51 toward or away from the support surface 3*a*, whereby it swing-drives the swing arm 41 around the swing shaft 40 via the drive pin 49, changing the position of the fixed blade 48 connected to this swing arm 41. In this way, a second cutting blade drive portion is formed by the swing arm 41, the drive pin 49, the elongated hole linking part 51, and the fixed blade drive cylinder 53. During the non-cutting period when the fabric 10 is not cut and during the notching period when a notch is formed in the fabric 10, the fixed blade 48 is driven away from the support surface 3*a*, and is arranged at the accommodation position above the cutting position. The accommodation position of the fixed blade 58 is radially on the inner side of the peripheral edge portion of the rotary blade 32, and on the side opposite the advancing direction of the cutter head 7 with respect to the normal extending downwards from the center of the rotary blade 32.

On one end side of the swing arm 41, there is mounted a coil spring 42 as the urging portion at the distal end of an arm extending from the vicinity of the swing shaft 40. The coil spring 42 is connected to the blade frame 30, and by the urging force exerted on one end side of the swing arm 41, urges the fixed blade 48 connected to the other end side of the swing arm 41 via the leaf spring 45 toward the support surface 3*a*.

The blade frame 30 is provided with a position sensor 55 detecting the swing arm 41. The position sensor 55 is formed of a photoelectric sensor, and detects the presence/absence of the swing arm 41 at the detection position by the intensity of the reflection of the projected light. In the case where the fixed blade 48 is at the position where it normally performs cutting in the vicinity of the support surface 3*a*, the position sensor 55 does not detect the swing arm 41. On the other hand, during the cutting period, when the fixed blade 48 swings away from the support surface 3*a* due to the resistance force from the fabric 10, and when the swing arm 41 is thereby caused to swing around the swing shaft 40, the position sensor 55 detects the swing arm 41. When a detection signal is output from the position sensor 55, this detection signal is input to the control device 11, and in response thereto, the control device 11 operates the fixed blade drive cylinder 53, and contracts the rod to drive the elongated hole linking part 51 away from the support surface 3*a*. As a result, the swing arm 41 is swing-driven around the swing shaft 40 via the drive pin 49, and the fixed blade 48 is driven away from the support surface 3*a* and is arranged at the accommodation position above the cutting position and on the side opposite the advancing direction. When, during the cutting period, the position sensor 55 detects the swing arm 41, the control device 11 stops the rotation of the cutter rotation motor 34, and, at the same time, stops the driving of the cutter head 7. The position sensor may be any one of the optical type, the electromagnetic type, and the contact type.

To be described will be the operation of cutting the fabric 10 and preparing a pattern piece by the above-described cutting apparatus.

First, the fabric roll 9 is placed on the unwinding roller of the unwinding machine 8 by the operator, and an unwinding command is input to the control device 11. In response to this, the unwinding roller operates, and the fabric 10 is drawn out of the roll 9. When the distal end portion of the fabric 10 drawn out is placed on one end side portion of the surface of the belt conveyor of the cutting table 2, and a draw-out command is input to the control device 11, the unwinding roller of the unwinding machine 8 performs the drawing-out operation, and the belt conveyor performs the feeding operation to feed the fabric 10 to the other end side. As a result, the fabric 10 is drawn out onto a cutting region on the support surface 3*a* of the cutting table 2. The cutting region is a region where cutting can be executed by the cutter of the cutter head 7.

Subsequently, cutting data indicating the configuration of a cutting pattern 80 is input to the control device 11 by the operator. On a display of the control device 11, there is displayed the configuration and position of the cutting pattern 80 corresponding to the cutting data, and by the operator who has visually checked the displayed information, the position and angle of the cutting pattern 80 with respect to the fabric 10 are adjusted. When the adjustment of the position and angle of the cutting pattern 80 has been completed, a cutting-start command is input to the control device 11 by the operator, and in response to this input, the control device 11 starts the cutting control.

Figure 4:
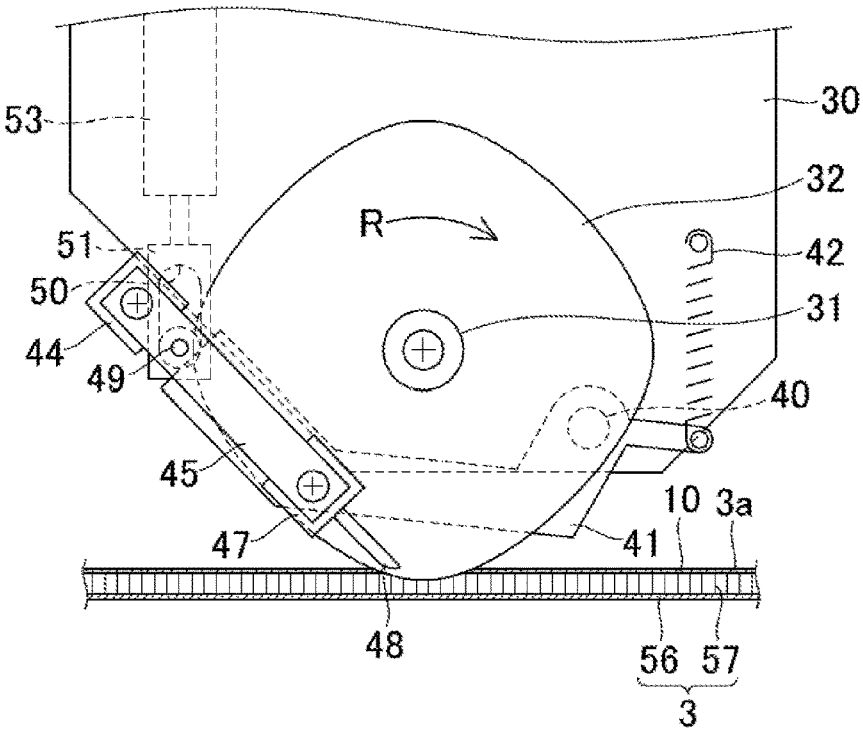
FIG. 4 is a side view illustrating the condition of the cutter head at the time of cutting start.

First, the control device 11 operates the cutter head drive mechanism, and drives the cutter head 7 within a plane parallel to the support surface 3*a*, arranging the rotary blade 32 of the cutter head 7 at the cutting start position where the cutting of the fabric 10 is started. While the cutter head 7 is moved to the cutting start position, the vertically moving frame 20 is held by the vertically moving cylinder 15 at the uppermost position where it is farthest from the support surface 3*a*, preventing the rotary blade 32 and the fixed blade 48 from getting caught by the fabric 10. Further, the rod of the fixed blade drive cylinder 53 is contracted to move the drive pin 49 away from the support surface 3*a*, and the fixed blade 48 connected to the swing arm 41 is held at the accommodation position radially on the inner side of the peripheral edge portion of the rotary blade 32 and on the opposite side in the advancing direction thereof. When the cutter head 7 reaches the cutting start position, the cutter rotation motor 34 is started to rotation-drive the rotary blade 32 in the direction of the arrow R as shown in FIG. 4, and, at the same time, the vertically moving cylinder 15 is operated to drive the vertically moving frame 20 in the direction of the support surface 3*a*, that is, downwards. As a result, the cutting edge of the rotating rotary blade 32 comes into contact with the fabric 10, and a notch is formed at the cutting start position of the fabric 10. Here, the fabric 10 is supported by the moquette-like conveyor belt 3, so that the rotary blade 32 extends through the fabric 10 coming into contact with the distal end of the velour 57 of the conveyor belt 3, and the notch is effectively formed therein. Furthermore, the rotary blade 32 does not reach the base cloth 56 of the conveyor belt 3, so that damage of the conveyor belt 3 is prevented.

Figure 5:
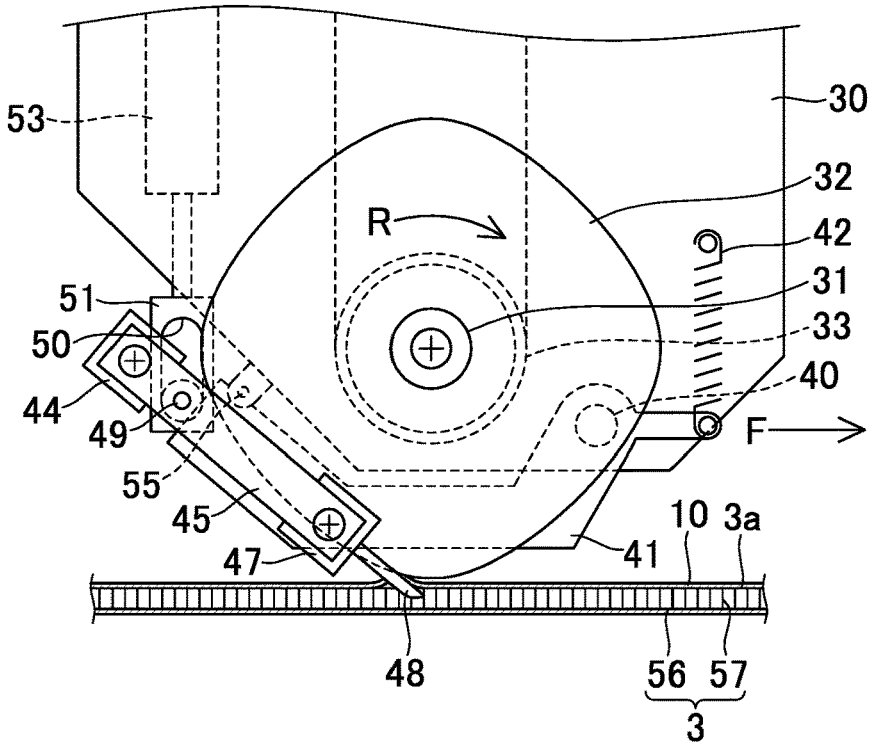
FIG. 5 is a side view illustrating the condition of the cutter head during cutting.

When a notch is formed at the cutting start position of the fabric 10, the rotary blade 32 is temporarily stopped, and, as shown in FIG. 5, the rod of the fixed blade drive cylinder 53 is expanded to bring the drive pin 49 close to the support surface 3*a*. As a result, the other end side of the swing arm 41 swings to the support surface 3*a* side by the urging force of the coil spring 42, and the fixed blade 48 is moved from the accommodation position shown in FIG. 4 to the support surface 3*a* side to be arranged at the cutting-time position shown in FIG. 5. To move the fixed blade 48 to the support surface 3*a* side, the operation of the fixed blade drive cylinder 53 of expanding the rod to swing the swing arm 41 may be conducted in the state in which the rotation of the rotary blade 32 is continued. When the fixed blade 48 is arranged at the cutting-time position, the distal end of the fixed blade 48 gets into the velour 57 of the conveyor belt 3, and the blade edge at the side edge portion of the fixed blade 48 comes into contact with the blade edge at the peripheral edge portion of the rotary blade 32. When the fixed blade 48 is arranged at the cutting-time position, the cutting height cylinder 19 is operated to move the vertically moving frame 20 away from the support surface 3*a*, that is, slightly upwards. As a result, the fabric 10 is raised from the support surface 3*a* by the fixed blade 48, and the fixed blade 48 is brought into contact with the side of the fabric 10 closer to the support surface 3*a*, whereas the rotary blade 32 is brought into contact with the side of the fabric 10 farther from the support surface 3*a*. Subsequently, the rotation-drive of the rotary blade 32 is resumed as indicated by the arrow R, and the cutter head 7 is driven in the direction in which the distal end of the fixed blade 48 is directed as indicated by the arrow F. This cutter head 7 is driven within a plane parallel to the support surface 3*a* along the route in accordance with the shape of the cutting pattern, and the blade frame 30 is rotation-driven around the rotation shaft 26 in accordance with the driving direction. As a result, the fabric 10 is cut along the cutting pattern by the fixed blade 48 and the rotary blade 32 to prepare a pattern piece.

When the cutting of the fabric 10 is thus performed by the rotary blade 32 and the fixed blade 48, the position at which the rotary blade 32 rotation-driven and the fixed blade 48 are held in contact is maintained at a position offset by 2 to 5 mm to the side opposite the intersection of the normal extending downwards from the center of the rotary blade 32 and the peripheral edge of the rotary blade 32 in the advancing direction of the cutter head. As a result, when the blade frame 30 is rotation-driven around the rotation shaft 26, that is, when cutting is performed so as to draw a bent cutting line, it is possible for the rotary blade 32 and the fixed blade 48 to smoothly change the advancing direction while cutting the fabric 10.

Figure 6:
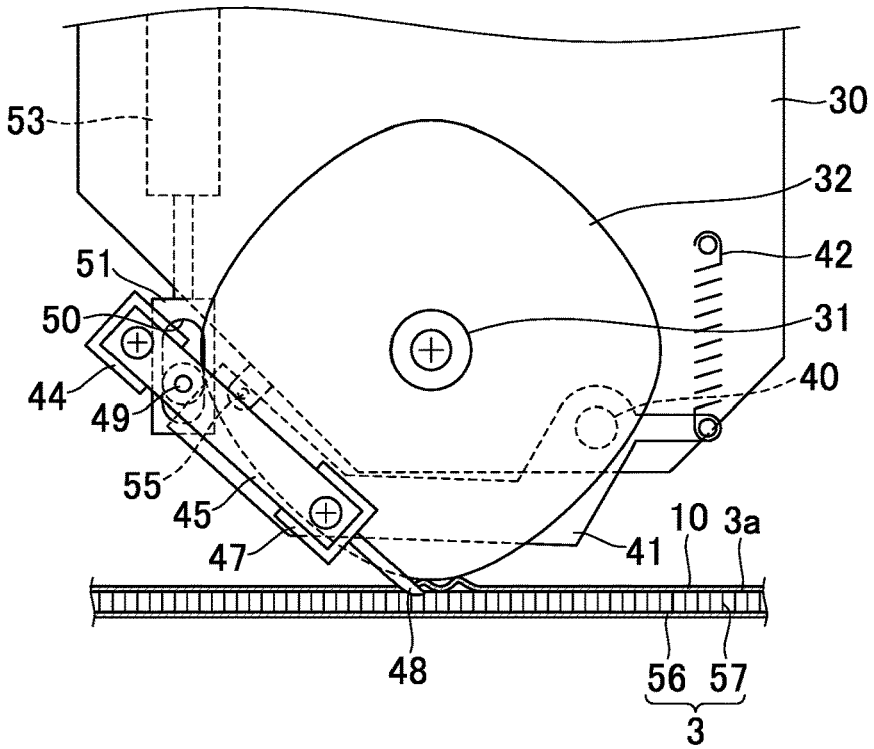
FIG. 6 is a side view illustrating the condition of the cutter head when a resistance force is exerted on a fixed blade.

When the cutting of the fabric 10 is performed by the cutter head 7, it may occur that an excessive resistance force is exerted on the fixed blade 48 from the fabric 10 due to a reduction in the sharpness of the rotary blade 32 and the fixed blade 48 and to wrinkles generated in the fabric 10. In many cases, such an excessive resistance force from the fabric 10 is generated when the cutting line formed by the rotary blade 32 and the fixed blade 48 is interrupted and the fixed blade 48 is locked at the end of the cutting line. When such a resistance force is exerted on the fixed blade 48, the resistance force is transmitted to the swing arm 41 through the fixed blade 48 as indicated by the arrow Q of FIG. 6, and the swing arm 41 swings around the swing shaft 40 due to this resistance force, with the result that the fixed blade 48 moves away from the support surface 3*a*. The magnitude of the resistance force acting on the fixed blade 48 and causing the swing arm 41 to swing is set by the spring constant of the coil spring 42, and can be set to a magnitude of 1.1 times to double the magnitude of the force acting on the fixed blade 48 when cutting the fabric 10 in the normal fashion. With the swinging of the swing arm 41, the position sensor 55 detects the swing arm 41, and, in accordance with the detection signal from this position sensor 55, the control device 11 operates the fixed blade drive cylinder 53. Through the control by the control device 11, the fixed blade drive cylinder 53 contracts the rod to drive the elongated hole linking part 51 away from the support surface 3*a*. As a result, the swing arm 41 is swing-driven around the swing shaft 40 via the drive pin 49, and the fixed blade 48 is driven away from the support surface 3*a* to be arranged at the accommodation position above the position at the time of cutting. In this way, when a predetermined resistance force larger than the resistance force when the fabric 10 is cut in the normal fashion is exerted on the fixed blade 48, the swing arm 41 is driven by the fixed blade drive cylinder 53 constituting the second cutting blade drive portion, and the fixed blade 48 is arranged at the accommodation position. Further, in accordance with the detection signal to the effect that the position sensor 55 has detected the swing arm 41, the control device 11 stops the rotation of the cutter rotation motor 34, and stops the driving of the cutter head 7.

In this way, when a predetermined resistance force is exerted on the fixed blade 48 from the fabric 10, the fixed blade 48 is driven and retracted to the accommodation position above the position during cutting and on the opposite side in the advancing direction, and the rotation of the rotary blade 32 and the driving of the cutter head 7 are stopped. As a result, it is possible to prevent the fixed blade 48 from being caught by the fabric 10 to move the fabric 10 in the driving direction of the cutter head 7. Further, it is possible to prevent an excessive resistance force from being continuously exerted on the fixed blade 48 from the fabric 10, so that it is possible to prevent damage of the fabric 10, damage of the fixed blade 48, and damage of the rotary blade 32. Further, the rotation of the rotary blade 32 is stopped, so that even when the fabric 10 is raised with the driving of the fixed blade 48, and the raised fabric 10 comes into contact with the rotary blade 32, it is possible to prevent the fabric 10 from being improperly cut.

Further, in the cutting apparatus of the present embodiment, when the fixed blade 48 receives a predetermined resistance force during cutting, the fixed blade drive cylinder 53 is operated to drive the fixed blade 48 to the accommodation position where it is arranged during notching. In this way, the second cutting blade drive portion driving the fixed blade 48 between the accommodation position at the time of notching and the position at the time of cutting is utilized, and the fixed blade 48 is retracted when it receives a predetermined resistance force, so that there is no need to provide a mechanism for reversing the fixed blade 143 to retract it as in the prior art. Thus, it is possible to simplify the structure of the cutter head 7 as compared with the prior art. Further, when the fixed blade 48 is driven and retracted to the accommodation position, the fixed blade 48 is driven to the accommodation position above the position during cutting and on the side opposite the advancing direction, so that the reversing fixed blade 143 does not come into contact with the support surface 3*a* as in the prior art. Thus, it is possible to effectively prevent damage of the support surface 3*a*, and to effectively prevent damage of the conveyor of the cutting table 2.

While in the first embodiment described above the fixed blade 48 is driven by the fixed blade drive cylinder 53, it may be driven by some other linear drive actuator such as a linear motor. Further, the swing shaft 40 may be rotation-driven by a rotary motor to drive the fixed blade 48.

Further, while in the first embodiment described above the swing arm 41 is detected by the position sensor 55 to detect movement of the fixed blade 48, movement of the fixed blade 48 may be detected by detecting the leaf spring 45.

Figure 7:
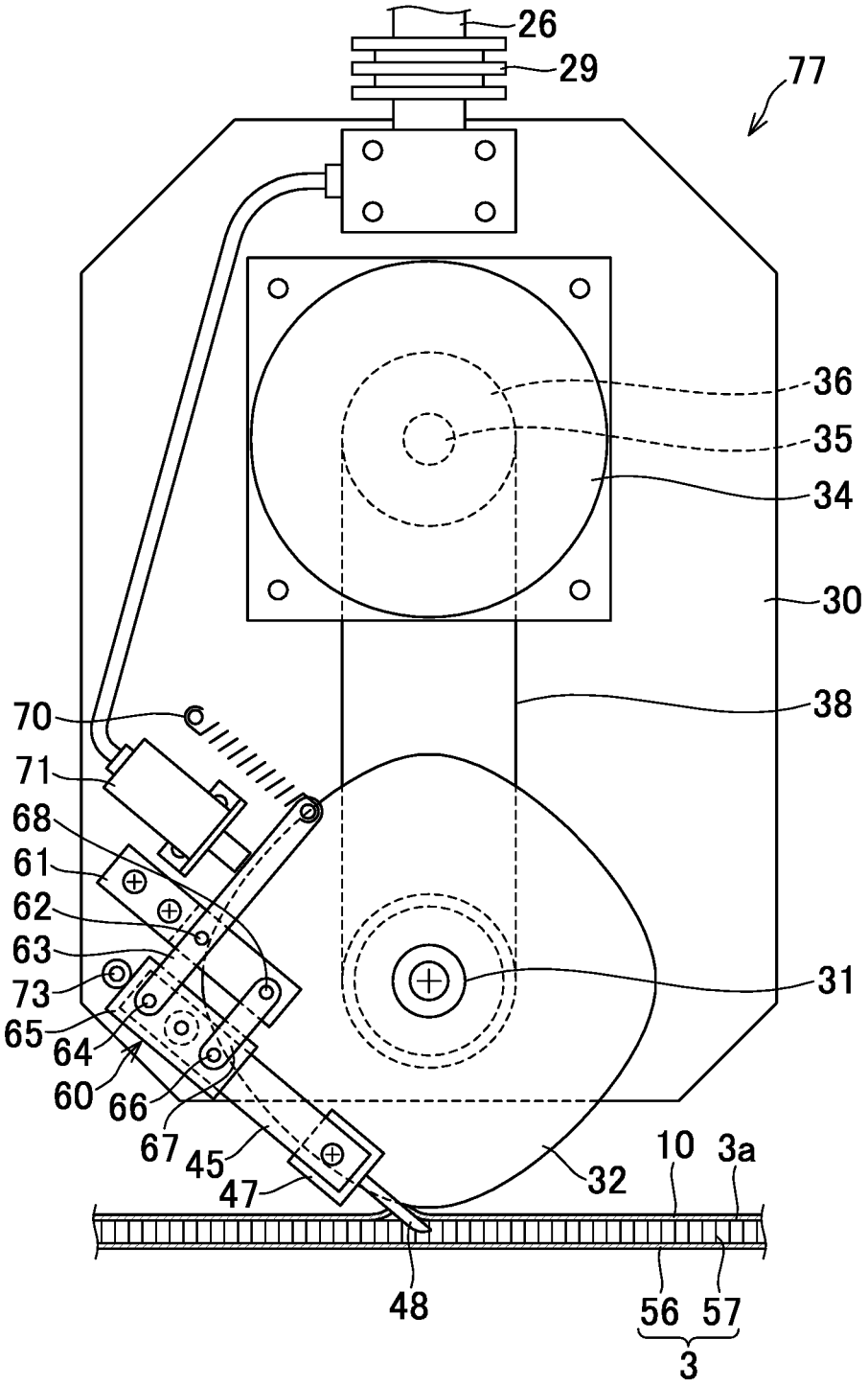
FIG. 7 is a side view of a cutter head that a cutting apparatus according to a second embodiment has.

FIG. 7 is a diagram illustrating a cutter head 77 with which the cutting apparatus of the second embodiment of the present invention is equipped. In the second embodiment, the components that are the same as those of the first embodiment are indicated by the same reference numerals, and a detailed description thereof will be left out.

In the cutting apparatus of the second embodiment, the second cutting blade drive portion driving the fixed blade 48 of the cutter head 77 includes a parallel link mechanism. A parallel link mechanism 60 includes a fixed link 61 fixed to the blade frame 30, a first arm 63 crossing this fixed link 61 and swingably pivoted, a second arm 65 one end of which is connected to one end of the first arm 63 and arranged parallel to the fixed link 61, and a swing link 67 one end of which is pivoted to the second arm 65 and the other end of which is pivoted to the fixed link 61 and arranged parallel to the first arm 63. The first arm 63 is pivoted to the fixed link 61 by a first link pin 62, and a coil spring 70 as an urging portion is connected to the other end thereof. The distal end of the rod of a fixed blade drive cylinder 71 as the linear drive actuator abuts the portion which is on the other end side of the first arm 63 and which is between the first link pin 62 and the connection portion of the coil spring 70. One end of the second arm 65 is connected to one end of the first arm 63 by a second link pin 64, and the second arm 65 is connected to a leaf spring 45 extending on the other end side. The fixed blade 48 is fixed to the distal end of the leaf spring 45 by a fixed blade holder 47, whereby the second arm 65 is connected to the fixed blade 48. One end of a swing link 67 is pivoted to the second arm 65 by a third link pin 66, and the other end thereof is pivoted to a fixed link 61 by a fourth link pin 68. Due to the parallel link mechanism 60 thus formed, the fixed blade 48 is urged toward the support surface 3*a* side by the coil spring 70, and the fixed blade 48 is driven between the position during cutting and the accommodation position by the fixed blade drive cylinder 71. In this way, a second cutting blade drive portion is formed by the parallel link mechanism 60 and the fixed blade drive cylinder 71. The blade frame 30 is provided with a position sensor 73 detecting movement of this second arm 65 of the parallel link mechanism 60 away from the support surface 3*a*.

Figure 8:
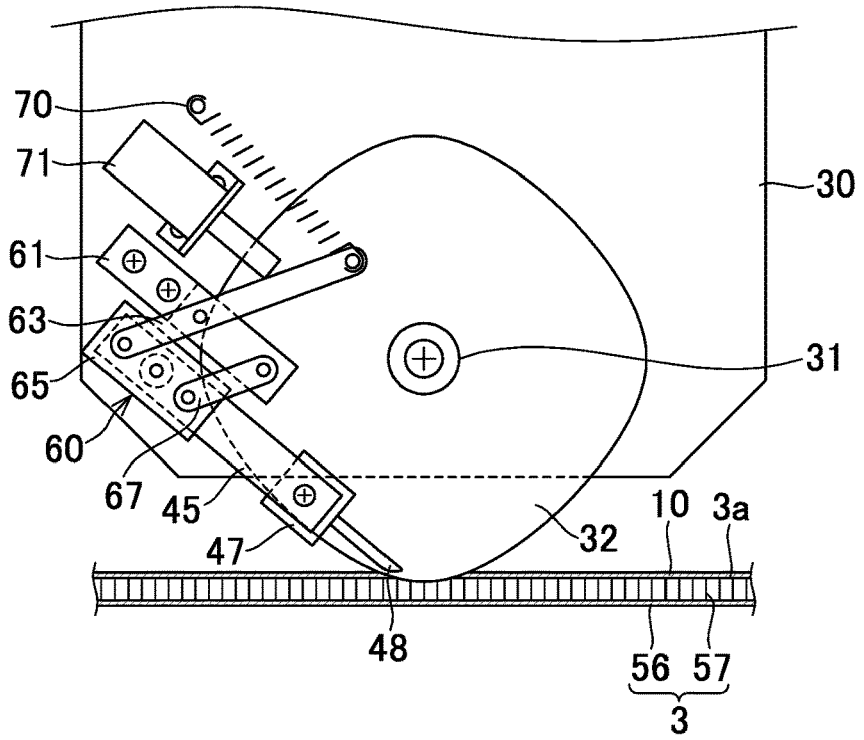
FIG. 8 is a side view illustrating the condition of the cutter head when the fixed blade moves to an accommodation position.

As shown in FIG. 8, in the cutting apparatus of the second embodiment, during the non-cutting period when the cutter head 77 does not perform the cutting of the fabric 10, and during the sheet notching period, the fixed blade 48 is arranged at the accommodation position by the fixed blade drive cylinder 71. That is, the rod of the fixed blade drive cylinder 71 is expanded, and the first arm 63 is swung away from the fixed blade drive cylinder 71 against the urging force of the coil spring 70. As a result, the second arm 65 is moved away from the support surface 3*a*, and the fixed blade 48 connected to the second arm 65 is arranged at the accommodation position radially on the inner side of the peripheral edge portion of the rotary blade 32 and on the side opposite the advancing direction thereof. When a notch is formed in the fabric 10, the rod of the fixed blade drive cylinder 71 is contracted as shown in FIG. 7, and the first arm 63 is swung to the fixed blade drive cylinder 71 side by the urging force of the coil spring 70. As a result, the second arm 65 is moved closer to the support surface 3*a*, and the fixed blade 48 connected to this second arm 65 is arranged at the position during the cutting where the blade edge of the side edge portion comes into contact with the blade edge at the peripheral edge portion of the rotary blade 32. The fixed blade 48 thus arranged at the position during the cutting is urged by the coil spring 70 to maintain it at the position during the cutting, and while doing so, the cutting of the fabric 10 is performed.

Figure 9:
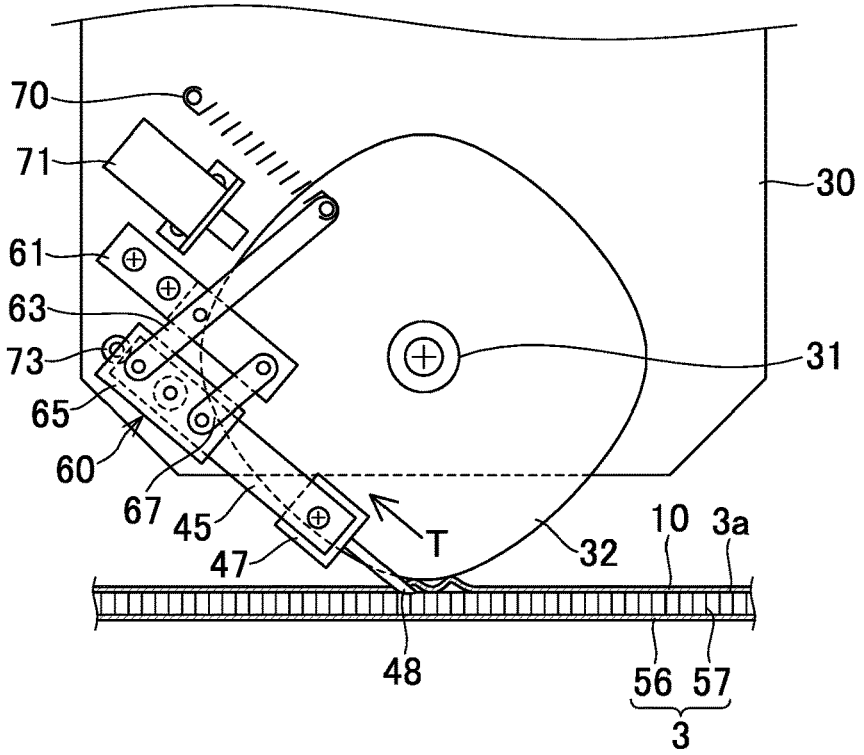
FIG. 9 is a side view illustrating the condition of the cutter head when a resistance force is exerted on the fixed blade.
Figure 10:
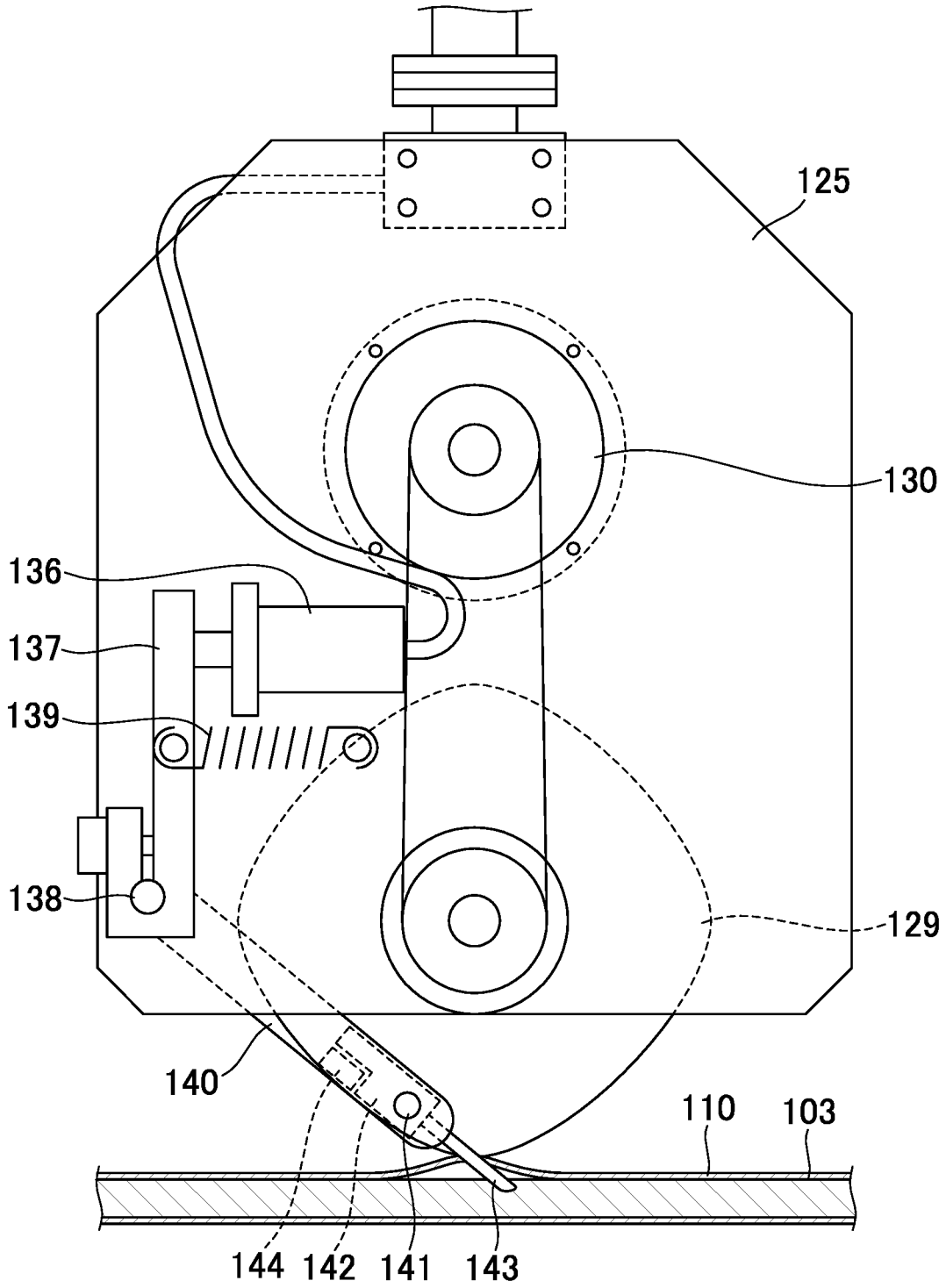
Fig. 10 (PRIOR ART)
FIG. 10 is a side view illustrating the condition of the cutter head of a conventional cutting apparatus.
Figure 11:
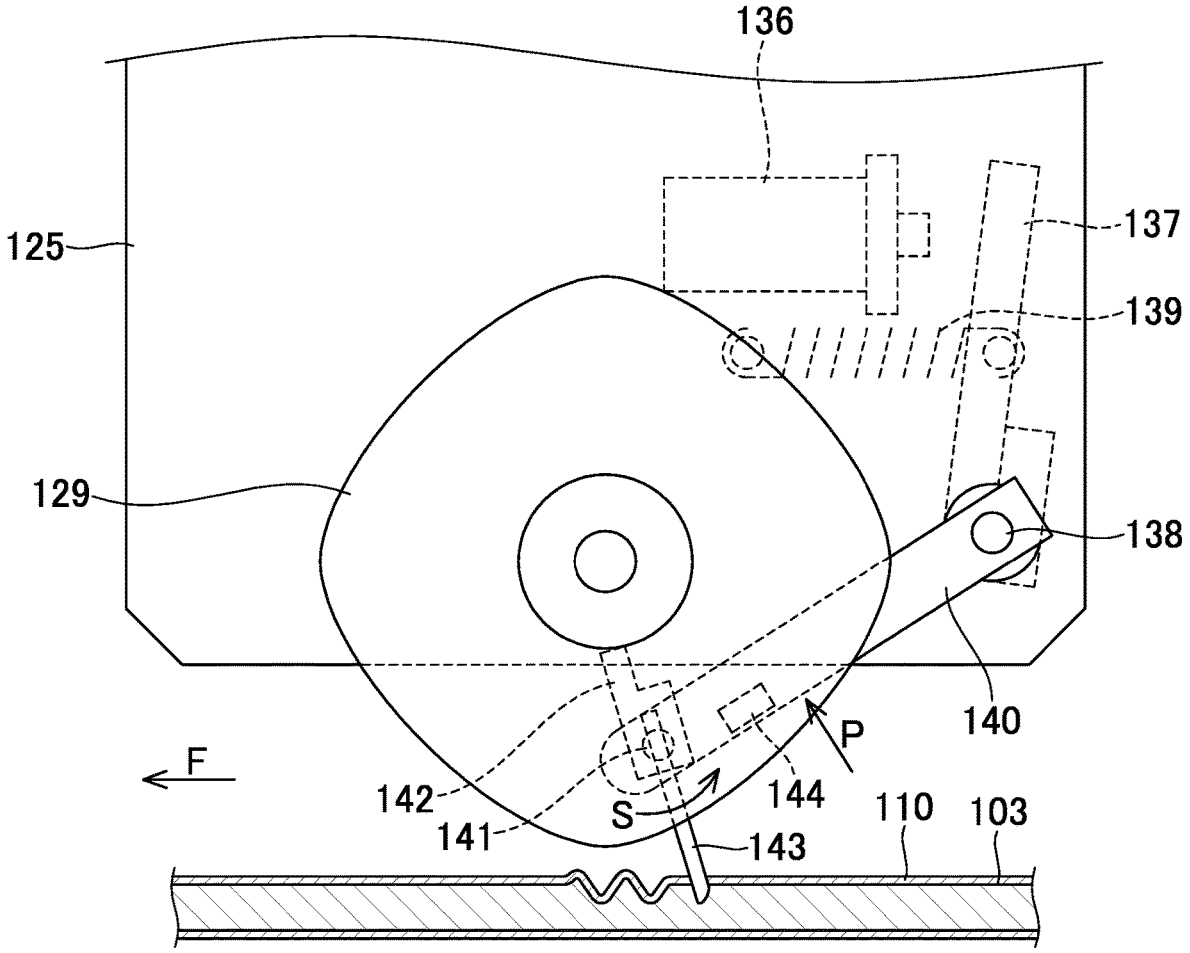
Fig. 11 (PRIOR ART)
FIG. 11 is a side view illustrating the condition of the cutter head when a resistance force is exerted on the fixed blade of the conventional cutting apparatus.

When cutting the fabric 10 by the cutter head 77 of the cutting apparatus of the present embodiment, in the case where a predetermined resistance force is exerted on the fixed blade 48 from the fabric 10 due, for example, to a reduction in the sharpness of the rotary blade 32 and the fixed blade 48, the second arm 65 moves such that the fixed blade 48 moves away from the support surface 3*a* as indicated by the arrow T of FIG. 9. With this, the position sensor 73 detects the movement and ascent of the second arm 65, and in accordance with the detection signal from this position sensor 73, the control device 11 operates the fixed blade drive cylinder 71 to move the fixed blade 48 to the accommodation position. That is, the fixed blade drive cylinder 71 expands the rod, and the first arm 63 is swung away from the fixed blade drive cylinder 71 against the urging force of the coil spring 70. As a result, the second arm 65 is moved away from the support surface 3*a*, and the fixed blade 48 connected to this second arm 65 is arranged at the accommodation position above the position during the cutting and on the side opposite the advancing direction. In accordance with the detection signal to the effect that the position sensor 73 has detected the second arm 65, the control device 11 stops the rotation of the cutter rotation motor 34, and stops the driving of the cutter head 77.

In this way, in the cutting apparatus of the present embodiment, when a predetermined resistance force is exerted on the fixed blade 48 from the fabric 10, the fixed blade 48 is moved in the extending direction of the fixed blade 48 by the link mechanism 60, so that it can be quickly arranged at the accommodation position. As a result, it is possible to effectively prevent the fixed blade 48 from being caught by the fabric 10 to move the fabric 10 in the driving direction of the cutter head 77, and to effectively prevent damage of the fabric 10, the fixed blade 48, and the rotary blade 32. Further, since the rotation of the rotary blade 32 is stopped, it is possible to prevent the fabric 10 from being improperly cut.

Further, the cutting apparatus of the present embodiment utilizes the parallel link mechanism 60 and the fixed blade drive cylinder 71 driving the fixed blade 48 between the accommodation position at the time of notching and the position during the cutting, and retracts the fixed blade 48 when it receives a predetermined resistance force. Thus, there is no need to provide a mechanism for reversing the fixed blade 143 to retract it as in the prior art, so that it is possible to simplify the structure of the cutter head 77 as compared with the prior art. Further, when the fixed blade 48 is driven and retracted to the accommodation position, the fixed blade 48 is driven to the accommodation position above the position during the cutting and on the side opposite the advancing direction, so that there is no fear of the reversing fixed blade 143 coming into contact with the support surface 3*a* as in the prior art. Thus, it is possible to effectively prevent damage of the support surface 3*a* and to effectively prevent damage of the conveyor of the cutting table 2. Further, the cutting apparatus of the present embodiment movably supports the fixed blade 48 by the parallel link mechanism 60, so that it is possible to move it from the position at the time of cutting to the accommodation position while maintaining the angle with respect to the support surface 3*a*.

While in the second embodiment described above the fixed blade 48 is driven by the fixed blade drive cylinder 71, it may also be driven by some other linear drive actuator such as a linear motor. Further, it is also possible to rotation-drive the first link pin 62 by a rotary actuator such as an electric motor to drive the fixed blade 48.

Further, while in the second embodiment described above movement of the fixed blade 48 is detected by detecting the second arm 65 by the position sensor 73, it is also possible to detect movement of the fixed blade 48 by detecting the first arm 63 and the swing link 67.

Further, while in the first and second embodiments the fixed blade drive cylinder 53, 71 constituting the second cutting blade drive portion drives the fixed blade 48 to the accommodation position during the non-cutting period for the fabric 10 and during its notching, the fixed blade 48 may not be driven to the accommodation position during the non-cutting period, with the fixed blade 48 being driven to the accommodation position at least during the notching period.

While the cutting apparatus of the first and second embodiments cuts a fabric as the sheet material, it may also cut some other sheet material such as leather, paper, and resin.

Further, the present invention is not restricted to a plotter type cutting apparatus but is also applicable to a cutting apparatus the cutter head of which is fixed at a predetermined position and to a cutting apparatus the cutter head of which is driven solely in one direction.

REFERENCE NUMERALS

1 cutting apparatus
2 cutting table
3 conveyor belt
3*a* support surface
4 cutter unit
7, 77 cutter head
30 blade frame
32 rotary blade
40 swing shaft
41 swing arm
42, 70 coil spring
45 leaf spring
47 fixed blade holder
48 fixed blade
49 drive pin
50 elongated hole
51 elongated hole linking part
53, 71 fixed blade drive cylinder
60 parallel link mechanism
61 fixed link
63 first arm

65 second arm

67 swing link

The invention claimed is:

1. A cutting apparatus comprising:

a support surface supporting a sheet material;

a cutter head having a first cutting blade coming into contact with the sheet material on the support surface on a surface of the sheet material which is farther from the support surface and a second cutting blade coming into contact with the sheet material on a surface of the sheet material which is nearer to the support surface; and a cutter head drive mechanism driving the cutter head within a plane parallel to the support surface, with the cutter head having a second cutting blade drive portion driving the second cutting blade at the time of notching the sheet material to an accommodation position above the position at the time of cutting the sheet material, wherein when, at the time of cutting the sheet material, a predetermined resistance force is exerted on the second cutting blade from the sheet material, the second cutting blade drive portion drives the second cutting blade to the accommodation position, wherein the first cutting blade is a rotary blade; and the second cutting blade is a fixed blade arranged such that at the time of cutting the sheet material, a distal end thereof is directed in the driving direction of the cutter head, and that a side edge portion thereof is in contact with a peripheral edge portion of the rotary blade, wherein the second cutting blade is driven by the second cutting blade drive portion to the accommodation position that is on the side opposite the driving direction of the cutter head with respect to the position at the time of cutting the sheet material, wherein the second cutting blade drive portion has:

a first spring urging the second cutting blade toward the support surface side; and an actuator driving the second cutting blade to the accommodation position against the urging force of the first spring, and wherein the second cutting blade drive portion has:

a swing arm which is pivoted to a frame of the cutter head by a swing shaft and to which the second cutting blade is connected;

a second spring connected to a side opposite the second cutting blade with respect to the swing shaft of the swing arm and urging the swing arm in a direction in which the second cutting blade advances toward the support surface;

a drive pin provided on the side to which the second cutting blade is connected with respect to the swing shaft of the swing arm;

an elongated hole linking part having an elongated hole with which the drive pin is slidably fit-engaged; and a linear drive actuator driving the drive pin against the urging force of the second spring via the elongated hole linking part.

2. The cutting apparatus according to claim 1, wherein the second cutting blade is retained such that at the time of cutting the sheet material, it comes into contact with the first cutting blade at a position offset to the side opposite the driving direction of the cutter head with respect to a normal extending downwards to the support surface from a rotation center of the first cutting blade.

3. The cutting apparatus according to claim 1, wherein the support surface is formed by a moquette-like sheet.

4. The cutting apparatus according to claim 1, further comprising:

a position sensor detecting the position of the swing arm of the second cutting blade drive portion; and a control unit which, upon detection that the displacement of the second cutting blade has exceeded a predetermined value based on the position of the swing arm from a signal from the position sensor, operates the linear drive actuator, and drives the second cutting blade away from the support surface via the elongated hole linking part, the drive pin, and the swing arm.

5. A cutting apparatus comprising:

a support surface supporting a sheet material;

a cutter head having a first cutting blade coming into contact with the sheet material on the support surface on a surface of the sheet material which is farther from the support surface and a second cutting blade coming into contact with the sheet material on a surface of the sheet material which is nearer to the support surface; and a cutter head drive mechanism driving the cutter head within a plane parallel to the support surface, with the cutter head having a second cutting blade drive portion driving the second cutting blade at the time of notching the sheet material to an accommodation position above the position at the time of cutting the sheet material, wherein when, at the time of cutting the sheet material, a predetermined resistance force is exerted on the second cutting blade from the sheet material, the second cutting blade drive portion drives the second cutting blade to the accommodation position, wherein the first cutting blade is a rotary blade; and the second cutting blade is a fixed blade arranged such that at the time of cutting the sheet material, a distal end thereof is directed in the driving direction of the cutter head, and that a side edge portion thereof is in contact with a peripheral edge portion of the rotary blade, wherein the second cutting blade is driven by the second cutting blade drive portion to the accommodation position that is on the side opposite the driving direction of the cutter head with respect to the position at the time of cutting the sheet material, wherein the second cutting blade drive portion has:

a first spring urging the second cutting blade toward the support surface side; and an actuator driving the second cutting blade to the accommodation position against the urging force of the first spring, and wherein the second cutting blade drive portion has:

a parallel link mechanism formed by a fixed link fixed to the frame of the cutter head, a first arm arranged so as to cross the fixed link and swingably pivoted, a second arm one end of which is connected to one end of the first arm and arranged parallel to the fixed link, and to which the second cutting blade is connected, and a swing link both ends of which are respectively pivoted to the fixed link and the second arm and which is arranged parallel to the first arm;

a second spring connected to the other end of the first arm of the parallel link mechanism and urging the first arm to bring the second cutting blade toward the support surface; and a linear drive actuator driving the other end side of the first arm of the parallel link mechanism against the urging force of the second spring.

6. The cutting apparatus according to claim 5, further comprising:

a position sensor detecting the position of the first arm, the second arm, or the swing link of the second cutting blade drive portion; and a control unit which, upon detection that the displacement of the second cutting blade has exceeded a predetermined value based on the position of the first arm, the second arm, or the swing link from a signal from the position sensor, operates the linear drive actuator, and drives the second cutting blade away from the support surface via the first arm and the second arm.

7. The cutting apparatus according to claim 4, wherein when the displacement of the second cutting blade exceeds a predetermined value, the control unit stops the operation of the first cutting blade.

8. The cutting apparatus according to claim 4, wherein when the displacement of the second cutting blade exceeds a predetermined value, the control unit stops the operation of the cutter head drive mechanism.

* * * * *